US006035880A

United States Patent [19]

Gazda

[11] Patent Number: 6,035,880

[45] Date of Patent: Mar. 14, 2000

[54] PRESSURE ACTIVATED SWITCH VALVE

[75] Inventor: Imre I. Gazda, Fort Worth, Tex.

[73] Assignee: Halliburton Energy Services, Inc., Dallas, Tex.

[21] Appl. No.: 08/846,866

[22] Filed: May 1, 1997

[51] Int. Cl.[7] ..... E21B 43/116

[52] U.S. Cl. ..... 137/68.16; 175/4.54; 175/4.56; 166/55.11

[58] Field of Search ..... 166/55.1, 319, 166/318, 321; 175/4.54, 4.56; 137/68.16, 68.17

[56] References Cited

U.S. PATENT DOCUMENTS

| | | | |
|---|---|---|---|
| 3,796,261 | 3/1974 | Nutter . | |
| 3,800,705 | 4/1974 | Tamplen | 175/4.56 X |
| 4,306,628 | 12/1981 | Adams, Jr. et al. | 175/4.56 |
| 4,544,034 | 10/1985 | George | 175/4.54 X |
| 4,650,010 | 3/1987 | George et al. | 175/4.56 X |
| 4,690,227 | 9/1987 | George et al. | 175/4.56 |
| 4,709,760 | 12/1987 | Crist et al. . | |
| 4,817,718 | 4/1989 | Nelson et al. . | |
| 4,862,964 | 9/1989 | George et al. . | |
| 4,911,251 | 3/1990 | George et al. | 175/4.56 X |
| 4,917,189 | 4/1990 | George et al. | 175/4.54 X |
| 5,176,220 | 1/1993 | Akkerman . | |
| 5,215,148 | 6/1993 | Ricles . | |
| 5,372,193 | 12/1994 | French . | |
| 5,492,173 | 2/1996 | Kilgore et al. | 166/66.4 |
| 5,603,384 | 2/1997 | Bethel et al. | 175/4.54 |

FOREIGN PATENT DOCUMENTS 2138925 10/1984 United Kingdom .

OTHER PUBLICATIONS

European Search Report for EP 98 30 3452

*Primary Examiner*—John Rivell
*Attorney, Agent, or Firm*—Paul I. Herman; Marlin R. Smith

[57] ABSTRACT

A pressure activated valve and associated methods of using same provide increased functionality and convenience in actuating a tool operatively positioned within a subterranean well. In a described embodiment, a switch valve is utilized to control actuation of a downhole power unit. The switch valve is configured to cause actuation of a switch within the downhole power unit in response to a differential fluid pressure. The differential fluid pressure is created by applying pressure to the interior of a tubing string to which the valve is attached.

57 Claims, 5 Drawing Sheets

PRESSURE ACTIVATED SWITCH VALVE

BACKGROUND OF THE INVENTION

The present invention relates generally to operations performed in conjunction with a subterranean well and, in an embodiment described herein, more particularly provides a valve used to control actuation of a tool positioned within the well and associated methods.

It is well known in the art to actuate a tool positioned within a subterranean well in response to hydrostatic pressure in the well. For example, U.S. Pat. No. 5,492,173 discloses a tool which includes an activation mechanism responsive to such hydrostatic pressure. The disclosure of that patent is incorporated herein by this reference.

The activation mechanism causes power to be supplied to a control circuit when the hydrostatic pressure reaches a predetermined amount. Thereafter, as the tool is lowered in the well, a timer determines when the power will be supplied to a motor in order to set a lock or plug within the well at an appropriate location. An accelerometer may also be utilized to reset the timer as the tool is displaced in the well, so that the lock or plug is not inadvertently set before the tool has arrived at the appropriate location.

Where the accelerometer is not utilized, the timer is set before the tool enters the well. This timer setting is based on an estimate of the time required to lower the tool to the appropriate location within the well. Unfortunately, this estimate may be incorrect, perhaps due to unforeseen difficulties in lowering the tool in the well, in which case it is likely that the lock or plug will be set prior to reaching the appropriate location. For example, an obstruction may be present in the wellbore or a portion of the wellbore may be deviated from vertical sufficiently far to impede lowering of the tool therein.

Of course, it is well known to displace a tool through a deviated portion of a well by attaching the tool to tubing, such as coiled tubing, and essentially push the tool through the wellbore. However, the use of tubing for this, or another, purpose presents other problems in actuating the tool. For example, it is generally considered uneconomical to perform a trial run with the tubing in order to gain an accurate estimate of the time required to lower the tool to the appropriate location for setting the lock or plug. Therefore, the timer setting estimate may be based on conjecture alone. As another example, if it is desired to utilize the accelerometer to periodically reset the timer as the tool is being lowered in the well, the tubing will typically not accelerate or decelerate at a sufficient level required to excite the accelerometer, due to the mass of the tubing.

Additionally, calculations of hydrostatic pressure in a well are frequently inaccurate. Such inaccuracies may occur due to human error, inaccurate measurement of fluid weight, inaccurate measurement of well deviation, inaccurate measurement of true vertical depth, etc. Since it is the hydrostatic pressure which has been utilized in the past to begin operation of the timer, such inaccuracies also affect the location at which the lock or plug is set by the tool.

The above circumstances may also apply to other tools which rely on fluid pressure within a well for their actuation. For example, in some cases firing heads utilized with perforating guns, setting tools, tubing cutters, etc. utilize fluid pressure for their actuation. Other tools, which do not presently rely on fluid pressure for their actuation for one or more of the above reasons, could be actuated by fluid pressure if the above problems could be resolved satisfactorily.

From the foregoing, it can be seen that it would be quite desirable to provide a means of actuating a tool or accomplishing another objective which does not require a predetermined hydrostatic pressure for its operation, but which actuates the tool or accomplishes its objective in response to an event which may be predictably controlled from the earth's surface. It is accordingly an object of the present invention to provide such an apparatus and associated methods of using the apparatus.

SUMMARY OF THE INVENTION

In carrying out the principles of the present invention, in accordance with an embodiment thereof, a valve is provided which is responsive to a fluid pressure differential controllable from the earth's surface, utilization of which does not require precise calculation of hydrostatic pressure within a well. The valve is suitable for use in conjunction with a tool conveyed into the well by tubing attached thereto. Methods of actuating the tool are also provided.

In broad terms, a valve is provided by the present invention, which is operatively interconnectable to two pressure regions of a subterranean well. Where a tubing string is positioned in the well, the pressure regions may correspond to the interior and exterior of the tubing. The valve includes a member that has two surface areas formed thereon. Each of the surface areas is in fluid communication with a corresponding one of the pressure regions. The member displaces when fluid pressure in one of the pressure regions is greater than fluid pressure in the other pressure region by a predetermined amount. Displacement of the member causes a chamber of the valve to be placed in fluid communication with one of the pressure regions.

In another aspect of the present invention, a valve is provided which is operatively positionable within a subterranean well having a tubing string disposed therein. The valve includes a housing, first and second fluid passages, a chamber and a member displaceable relative to the housing. The housing is sealingly connectable to the tubing string, thereby placing the first fluid passage in fluid communication with the interior of the tubing string and placing the second fluid passage in fluid communication with an annulus formed between the tubing string and the wellbore. The member is displaceable, in response to a difference between fluid pressures in the first and second fluid passages, from one position in which the chamber is isolated from the second fluid passage to another position in which the chamber is in fluid communication with the second fluid passage.

In yet another aspect of the present invention, apparatus is provided which is operatively positionable within a subterranean wellbore. The apparatus includes a switch disposed within a first chamber and a piston reciprocably disposed between the first chamber and another, second, chamber. The piston is displaceable to engage the switch in response to a difference in pressure between the two chambers. A valve is interconnected to the second chamber. The valve opens to place the second chamber in fluid communication with fluid pressure within the well. Alternatively, the switch may be an explosive device, in which case the piston causes detonation of the explosive device in response to a difference in pressure between the chambers.

In still another aspect of the present invention, a method is provided for communicating pressure to a chamber, which method may be utilized to actuate a tool. A valve is interconnected with a tubing string to which the chamber is also connected. The valve is placed in fluid communication with the interior and exterior of the tubing string, and with the chamber. Fluid pressure is applied to the interior of the tubing string to create a predetermined differential pressure from the interior to the exterior of the tubing string. The valve is then opened in response to the predetermined differential pressure, thereby communicating fluid pressure to the chamber. When used to actuate the tool, a piston may be displaced in response to the fluid pressure entering the chamber, thereby causing the piston to engage a structure positioned in another chamber within the tool.

The present invention permits operations to be performed in subterranean wells with greater precision, economy and efficiency. These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
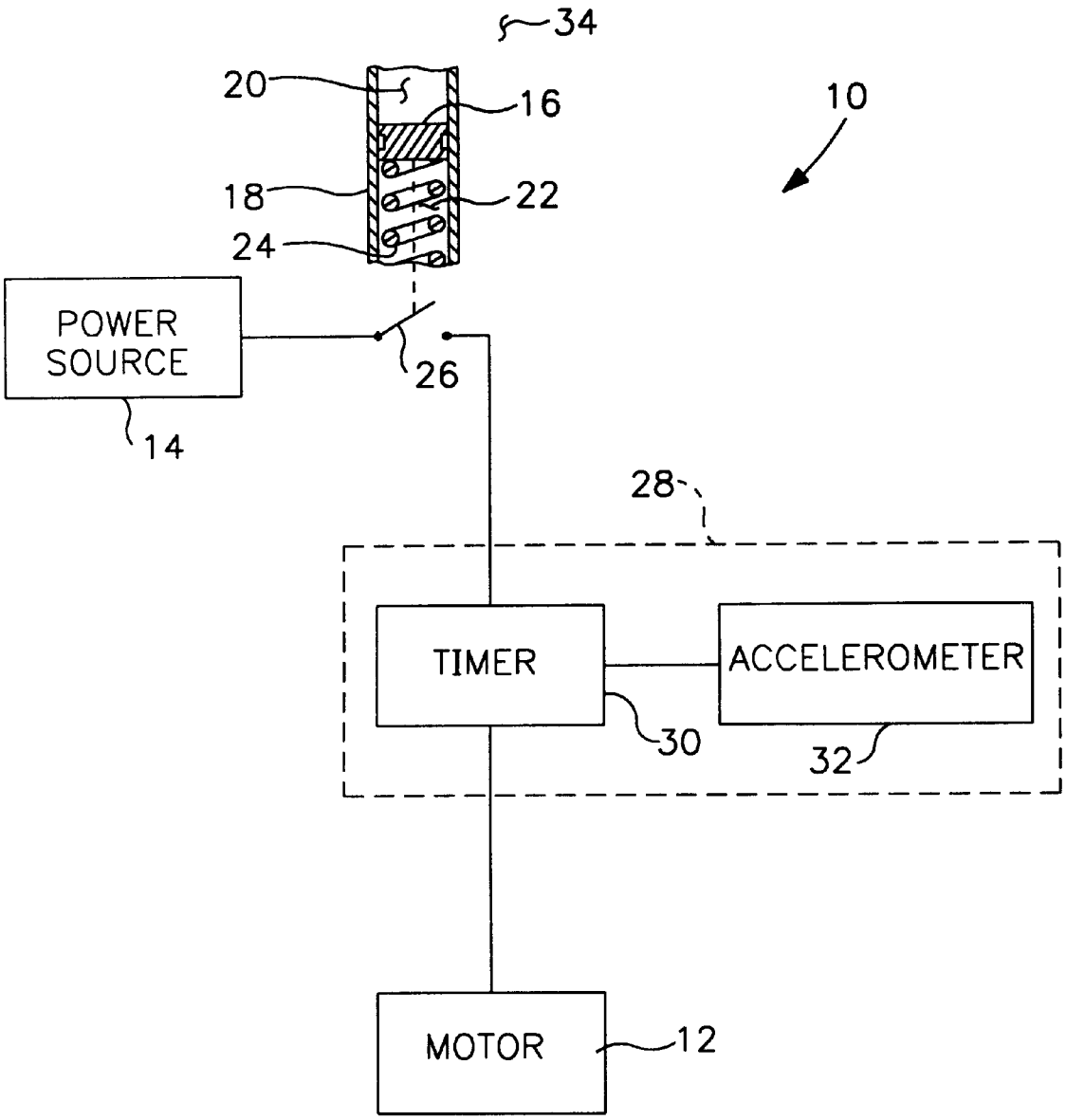
FIG. 1 PRIOR ART
FIG. 1 (Related Art) is schematicized view of a pressure activated tool for use in a subterranean well.

Representatively and schematically illustrated in FIG. 1 is a tool 10 similar to that described in the incorporated U.S. Pat. No. 5,492,173. Specifically, FIG. 1 shows various devices used to control activation of a motor 12 within the tool 10. In general, the devices are interposed between a power source 14 and the motor 12, in order to control when the motor will be activated in the tool described in the incorporated patent, activation of the motor 12 is utilized to set a plug or lock (not shown) at a particular desired location within a subterranean well.

A piston 16 is axially reciprocably and sealingly disposed within a cylinder 18 of the tool 10. An upper volume 20 within the cylinder 18 above the piston 16 is exposed to hydrostatic pressure within the well. Thus, as the tool 10 is lowered into the well, fluid pressure in the upper volume 20 gradually increases.

A lower volume 22 within the cylinder 18 below the piston 16 contains atmospheric pressure. A compression spring 24 is disposed within the lower volume 22 and exerts an upwardly biasing force on the piston 16. Therefore, the hydrostatic pressure in the upper volume 20 must exceed a combination of atmospheric pressure and the biasing force of the spring 24 in order to downwardly displace the piston 16 relative to the cylinder 18.

Operatively interconnected to the piston 16, and also disposed within atmospheric pressure, is a switch 26. The position of the switch 26 (i.e., whether open or closed) determines whether power is supplied from the power source 14 to a control circuit 28. The switch 26 is closed when the piston 16 displaces downwardly relative to the cylinder 18, and the switch is opened when the piston 16 is displaced upwardly relative to the cylinder by the spring 24. It will be readily appreciated by one of ordinary skill in the art that a predetermined hydrostatic pressure must be present in the volume 20 for the switch 26 to be closed, and for power to be supplied to the control circuit 28.

The control circuit 28 includes a timer 30 and an accelerometer 32. The timer 30 is of the type which counts down from a set time period, at which time the timer conducts and supplies power to the motor 12. The time period may be set based upon an estimate, for example, of the time required to properly position the tool 10 within the well. This time period must be set before the tool 10 enters the well.

As an alternative to setting the time period based on an estimate of the time required to position the tool 10 within the well, the accelerometer 32 may be utilized to periodically reset the timer 30 whenever the tool accelerates or decelerates (e.g., as the tool is being lowered in the well). In that case, the time period for which the timer 30 is set corresponds to the amount of time after the tool 10 has stopped (no longer accelerates or decelerates), at which it is desired to set the plug or lock in the well. If run on wireline or slickline, the tool 10 may be conveniently stopped periodically during its descent into the well by merely applying a brake on the wireline or slickline reel, to thereby ensure that the accelerometer 32 resets the timer 30, so that the plug or lock is not set prematurely. However, when run on coiled tubing, or another type of tubing string, the mass of the tubing may prevent sufficient acceleration or deceleration needed to reset the timer 30, and the tubing may not be so easily or conveniently stopped periodically.

Note that the upper volume 20 is open to a wellbore 34 of the well surrounding the cylinder 18. This wellbore 34 is the source of the hydrostatic pressure used to displace the piston 16. When run on wireline or slickline, the wellbore 34 is also the only pressure region available for displacing the piston 16. The fluid pressure in the wellbore 34 may be altered at the earth's surface by, for example, pumping into the wellbore to increase the pressure therein, but it will be readily appreciated that any such added pressure is cumulative to the hydrostatic pressure, and so any inaccuracies in calculating the hydrostatic pressure are not removed or changed by adding pressure thereto. Thus, even though fluid pressure in the wellbore 34 may be altered from the earth's surface, it cannot be more accurately controlled than the hydrostatic pressure.

Figure 2:
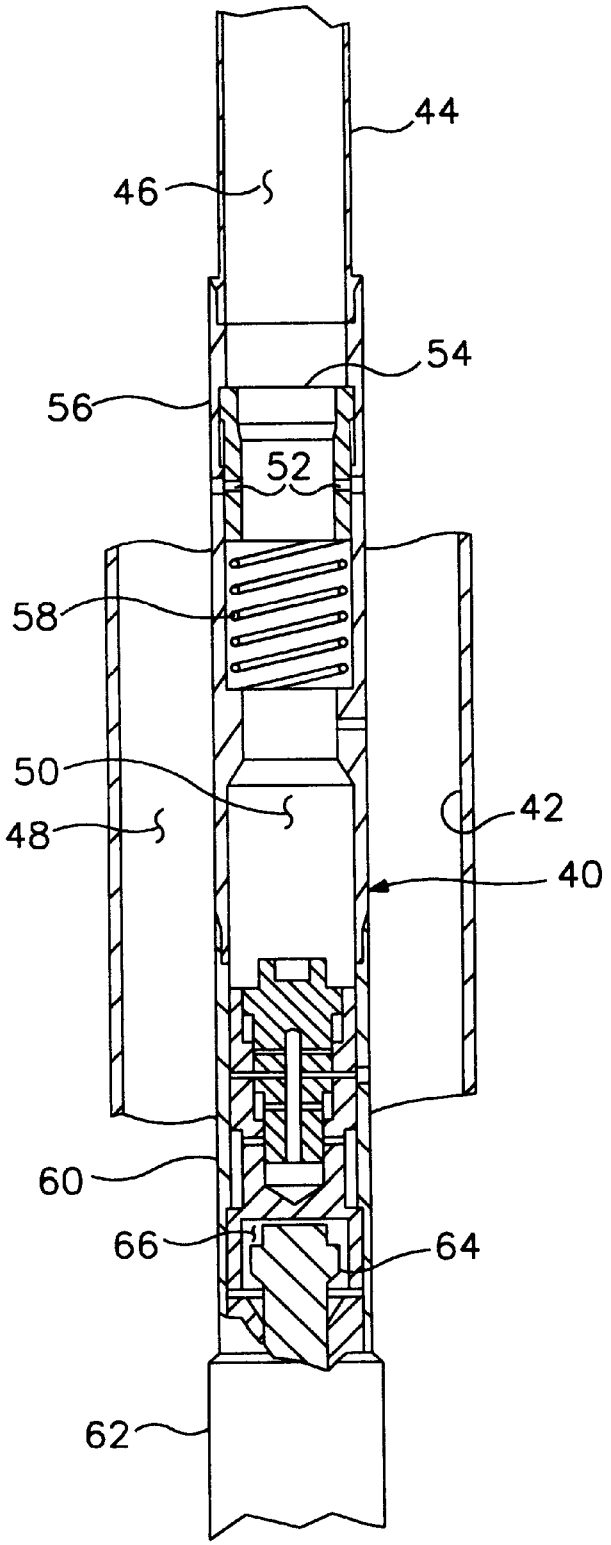
FIG. 2 is a cross-sectional view of a pressure activated switch valve embodying principles of the present invention and associated apparatus operatively interconnected with the tool of FIG. 1.

Referring additionally now to FIG. 2, apparatus 40 is representatively illustrated which embodies principles of the present invention. In the following description of the apparatus 40 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The apparatus 40 is conveyed into a wellbore 42 by tubing, such as coiled tubing 44, extending to the earth's surface. However, it is to be clearly understood that other forms of conveyance may be utilized without departing from the principles of the present invention. It will be readily appreciated that, by using a tubing string 44 to convey the apparatus 40, two pressure regions are available for use in operating the apparatus, namely, the interior 46 of the tubing 44, and the annulus 48 radially between the apparatus and the wellbore 42.

The apparatus 40 is sealingly attached to the tubing 44, such that the tubing interior 46 is in fluid communication with an internal fluid passage 50 extending axially within the apparatus. As shown in FIG. 2, initially the fluid passage 50 is pressure equalized with the annulus 48. This pressure equalization is provided by a pair of orifices 52 formed radially through a shuttle 54 of a conventional circulating valve 56. It is to be understood that it is not necessary to provide the circulating valve 56 for use with the apparatus 40, but that the applicant prefers its use, since it permits the tubing 44 to fill with fluid as it is lowered into the well. Other devices, such as a conventional flow diverter valve, etc., may be used in place of the circulating valve 56 without departing from the principles of the present invention. A suitable circulating valve is Halliburton part no. 698.10150, and a suitable flow diverter valve is Halliburton part no. 698.19035, both of which are manufactured by, and available from, Halliburton Company of Duncan, Okla.

To close the valve 56 and thereby provide fluid isolation between the interior 46 of the tubing 44 and the annulus 48, fluid is pumped from the earth's surface, through the interior of the tubing, outward through the orifices 52 and into the annulus 48. As the fluid passes through the orifices 52, the fluid experiences a pressure drop, and so the fluid pressure in the interior 46 becomes greater than the pressure in the annulus 48. A greater rate of fluid flow produces a correspondingly greater pressure differential.

When the pressure differential is sufficiently great to overcome the upwardly biasing force of a compression spring 58 within the valve 56, the shuttle 54 displaces axially downward and closes off the orifices 52. At this point, a pressure increase will be observed at the earth's surface and no further pressure differential need be applied. Only a minimum amount of pressure differential need be maintained to keep the orifices 52 closed, for example, approximately 100 psid.

A valve 60 is sealingly attached to the circulating valve 56 and is in fluid communication with the fluid passage 50. Attached below the valve 60 is a tool 62, which is similar in many respects to the tool 10 previously described. Specifically, in one respect, the tool 62 includes a piston 64 which may be displaced to engage a structure within the tool, in order to activate the tool. The valve 60 is utilized to control fluid communication with a chamber 66 to which the piston 64 is exposed, in order to control activation of the tool 62.

The valve 60 is in fluid communication with the interior 46 of the tubing 44, and with the annulus 48. In an important aspect of the present invention, the valve 60 opens to permit fluid communication with the chamber 66 when a predetermined pressure differential exists between the interior 46 and the annulus 48. It will be readily appreciated that this pressure differential is easily and accurately controllable from the earth's surface at any time. It will also be readily appreciated that this method of activating the tool 62 does not require reliance on any estimates of time, or on movements of the tool and its means of conveyance. Additionally, this method permits an operator to remove the tool 62 from the well without any danger that it will be activated as it is being retrieved.

Figure 3A:
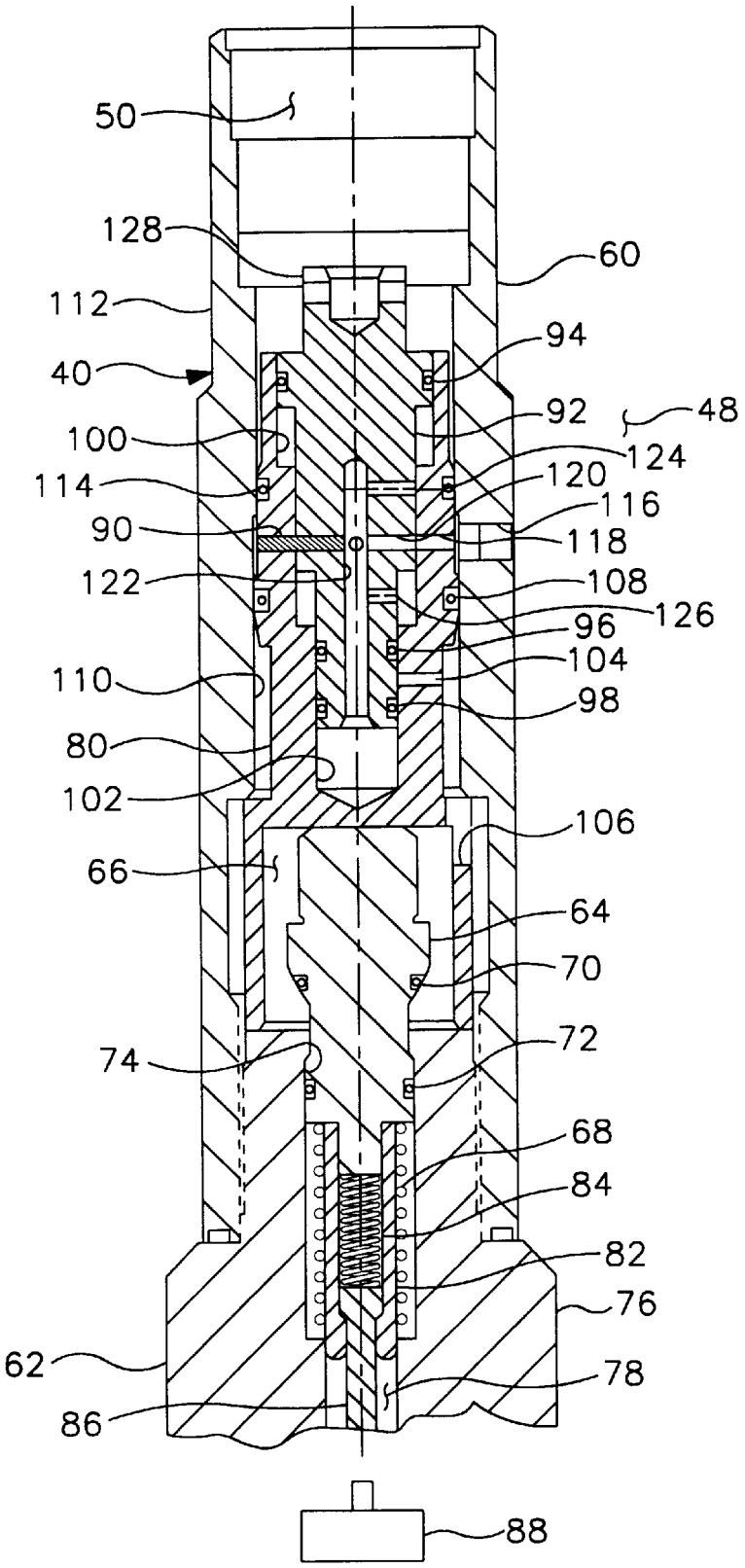
FIGS. 3A–3B are enlarged cross-sectional views of the pressure activated switch valve of FIG. 2 operatively interconnected to the tool of FIG. 1, the valve being shown in a closed configuration thereof in FIG. 3A and the valve being shown in an open configuration thereof in FIG. 3B.

Referring additionally now to FIG. 3A, the apparatus 40 is representatively illustrated separated from the circulating valve 56 and tubing 44 for illustrative clarity. FIG. 3A is also somewhat enlarged as compared to FIG. 2, so that details of the valve 60 and tool 62 may be more clearly shown and described.

The piston 64 is axially upwardly biased by a compression spring 68. An axially spaced apart set of circumferential seals 70, 72 are carried externally on the piston 64. The lower seal 72 is sealingly received in a central axial seal bore 74 formed in a top sub 76 of the tool 62. The seal 72 isolates the chamber 66 from an atmospheric chamber 78 within the tool 62.

It will be readily appreciated that if fluid pressure in the upper chamber 66 is sufficiently greater than fluid pressure in the lower chamber 78 to overcome the biasing force of the spring 68, the piston 64 will be downwardly displaced relative to the top sub 76. Initially, in the configuration shown in FIG. 3A, both of the chambers 66, 78 are at atmospheric pressure, and the piston 64 is upwardly biased by the spring 68 into contact with a sleeve 80 of the valve 60. When, however, the valve 60 is opened, the upper chamber 66 will be placed in fluid communication with the annulus 48, thereby causing axially downward displacement of the piston 64, provided sufficient fluid pressure exists in the annulus to compress the spring 68.

Attached to the piston 64, and extending downwardly therefrom, is a generally tubular spring retainer 82. The spring retainer 82 radially outwardly surrounds a compression spring 84, which exerts an axially downwardly biasing force on a generally rod shaped plunger 86. An external shoulder formed on the plunger 86 engages an internal shoulder formed on the spring retainer 82 to prevent removal of the plunger from within the spring retainer.

When the piston 64 is axially downwardly displaced, the spring retainer 82, spring 84 and plunger 86 are displaced therewith. Eventually, the plunger 86 will contact a structure, such as a switch 88, disposed within the tool 62. It may now be appreciated that the spring 84 lessens the impact of the plunger 86 on the switch 88 and, when maintained in contact therewith, exerts an approximately constant biasing force thereon. However, it is to be clearly understood that it is not necessary for the spring retainer 82, spring 84 and plunger 86 to be provided in the tool 62 according to the principles of the present invention, since, depending upon the structure to be engaged, it may be desirable to extend the piston 64 downwardly and have the piston engage the structure directly. It is also to be understood that the structure may be other than the switch 88 without departing from the principles of the present invention.

At this point it may be seen that the tool 10 shown in FIG. 1 and generally described above may be used for the tool 62 shown in FIG. 3A. In that case, the piston 64 may correspond to the piston 16, the spring 68 may correspond to the spring 24, the chamber 66 may correspond to the chamber 20, the chamber 78 may correspond to the chamber 22, the switch 88 may correspond to the switch 26, etc. Thus, when the valve 60 is opened, the piston 64 may engage the switch 88 (via the plunger 86) to close it and supply power to the control circuit 28. Alternatively, since opening of the valve 60 may be accurately controlled from the earth's surface, as will be described more fully hereinbelow, the switch 88 may be interconnected directly between the power source 14 and the motor 12, so that the motor is powered immediately upon opening of the valve.

The valve 60 is maintained in its closed configuration as shown in FIG. 3A by a shear pin 90 installed radially through a sidewall portion of the sleeve 80 and a member 92 axially reciprocably and sealingly disposed within the sleeve. In its upwardly disposed position relative to the sleeve 80, as shown in FIG. 3A, the member 92 prevents fluid communication between the annulus 48 and the chamber 66, and the valve 60 is closed. However, when the member 92 is displaced to its downwardly disposed position relative to the sleeve 80 (see FIG. 3B), such fluid communication is permitted, and the valve 60 is open.

The member 92 carries three axially spaced apart circumferential seals 94, 96, 98 externally thereon. The upper seal 94 is sealingly received in an upper bore 100 formed internally on the sleeve 80. The lower seals 96, 98 are sealingly received in a lower bore 102 formed internally on the sleeve 80, with the seals axially straddling a fluid passage 104 formed radially through the sleeve.

The fluid passage 104 is in fluid communication with the chamber 66 via an opening 106 formed through the sleeve 80 below the bore 102. However, the fluid passage 104 is isolated from fluid communication with the annulus 48 by the seals 96, 98, and by a circumferential seal 108 carried externally on the sleeve 80. The seal 108 sealingly engages a bore 110 formed internally on a generally tubular housing 112 radially outwardly surrounding the sleeve 80. The housing 112 is configured for sealing attachment to the tubing 44 or circulating valve 56.

The seal 108 and another circumferential seal 114 carried externally on the sleeve 80 axially straddle a fluid passage 116 formed radially through the housing 112. The fluid passage 116 is in fluid communication with one or more circumferentially spaced apart fluid passages 118 (only one of which is visible in FIG. 3A) formed radially through the sleeve 80, a series of circumferentially spaced apart fluid passages 120 formed radially through the member 92, an axially extending fluid passage 122 formed in the member and axially spaced apart fluid passages 124, 126 formed radially through the member.

It will be readily appreciated by one of ordinary skill in the art that if the fluid pressure in the fluid passage 50 is equal to the fluid pressure in the annulus 48, the member 92 is balanced, that is, the member is not biased axially upward or downward thereby. This is due to the fact that an upper surface area of the member 92 exposed to fluid pressure in the fluid passage 50 is equal to a lower surface area of the member exposed to fluid pressure in the annulus 48. These surface areas correspond to the area of the bore 100 sealingly engaged by the seal 94. If, however, additional fluid pressure is applied to the fluid passage 50, such as by circulating fluid from the earth's surface, through the tubing 44 and radially outward through the orifices 52, the member 92 will be downwardly biased by the difference between the fluid pressure in the fluid passage 50 and the fluid pressure in the annulus 48.

If sufficient additional fluid pressure is applied to the fluid passage 50, for example, by closing the circulating valve 56 as described above and continuing to apply fluid pressure to the interior 46 of the tubing 44, the downwardly biasing force on the member 92 produced by the differential pressure between the fluid passage 50 and the annulus 48 will eventually shear the shear pin 90 and permit the member to downwardly displace relative to the sleeve 80. Thus, by appropriately sizing the shear pin 90, or by installing an appropriate number of the shear pins when assembling the valve 60, the operator may select the differential pressure at which the shear pin 90 shears. The applicant prefers that the shear pin 90 shear when the fluid pressure in the fluid passage 50 exceeds the fluid pressure in the annulus 48 by approximately 600 psi, but it is to be understood that any predetermined differential pressure may be used without departing from the principles of the present invention.

Note that an upper end 128 of the member 92 extends axially outward from the sleeve 80. The end 128 is exposed to, and extends somewhat into, the fluid passage 50. As will be more fully described hereinbelow, a weighted bar or other object may be dropped through the interior 46 of the tubing 44 from the earth's surface to impact the end 128 and shear the shear pin 90, as an alternate method of downwardly displacing the member 92 and opening the valve 60. It is, thus, a distinct advantage of the apparatus 40 that it may activated using no less than two independent methods, each of which is predictably, controllably and conveniently performed from the earth's surface.

Figure 3B:
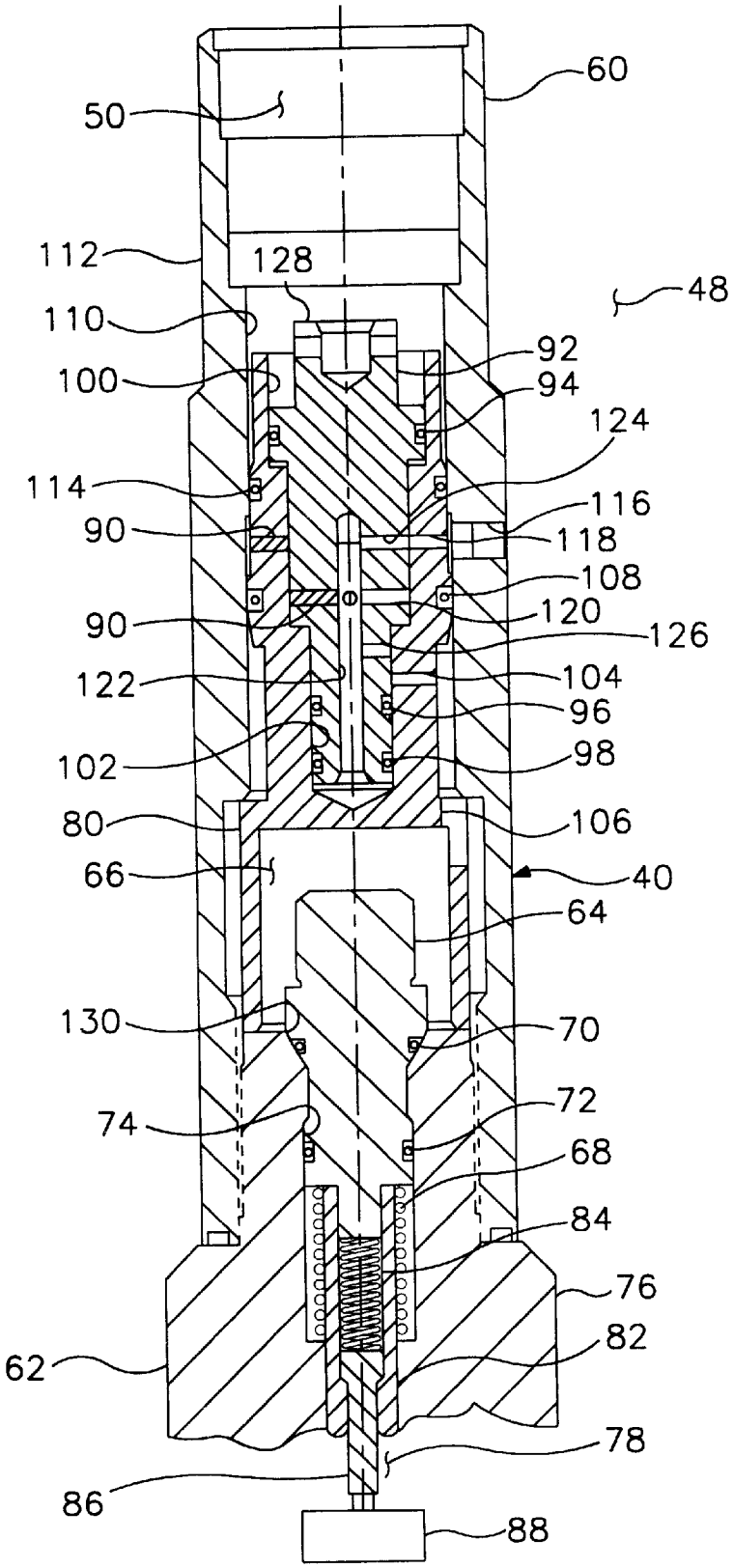

Referring additionally now to FIG. 3B, the apparatus 40 is representatively illustrated with the valve 60 open and the tool 62 activated thereby. The member 92 is in its downwardly disposed position relative to the sleeve 80, so that the seals 96, 98 no longer axially straddle the fluid passage 104. Consequently, the fluid passage 104 is now in fluid communication with the annulus 48 via the fluid passages 126, 122, 124, 118 and 116.

Fluid pressure in the annulus 48 has entered the chamber 66 and caused axially downward displacement of the piston 64. The upper seal 70 now sealingly engages an inclined shoulder 130 internally formed on the top sub 76, preventing further downward displacement of the piston 64. The plunger 86 has downwardly displaced with the piston 64 and has engaged the switch 88.

The shear pin 90 is sheared, a predetermined differential pressure between the fluid passage 50 and the annulus 48 having been achieved. Alternatively, the shear pin 90 may have been sheared by applying sufficient force to the end 128 of the member 92 by, for example, impacting it with a weighted object.

It is to be clearly understood that fluid pressures within the well, other than that in the annulus 48, may be placed in fluid communication with the chamber 66 without departing from the principles of the present invention. For example, the fluid passage 10, may be appropriately positioned so that fluid communication with the fluid passage 50 is permitted when the member 92 is displaced to open the valve 60. In that manner, the tool 62 may be activated with fluid pressure in the interior 46 of the tubing 44, instead of fluid pressure in the annulus 48. Additionally, alternative differential pressures may be utilized to open the valve 60. For example, fluid pressure in the annulus 48 greater than fluid pressure in the fluid passage 50 may be utilized to open the valve 60 by appropriate reconfiguration of the various seals and fluid passages therein.

Figure 4:
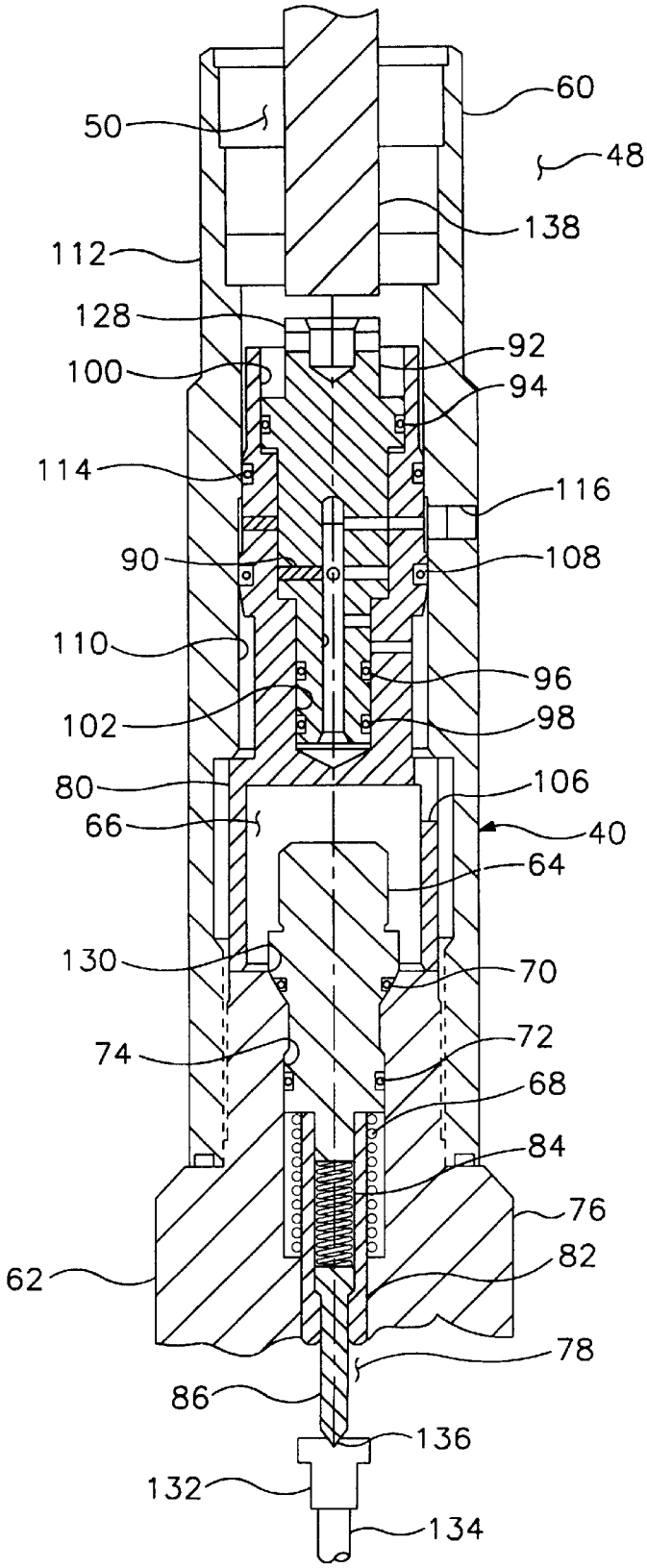
FIG. 4 is an enlarged cross-sectional view of the valve of FIG. 2 operatively interconnected to a perforating gun firing head.

Referring additionally now to FIG. 4, an alternate construction of the apparatus 40 is representatively illustrated. As shown in FIG. 4, the tool 62 includes an explosive device, such as an initiator 132 and detonating cord 134, in the atmospheric chamber 78. The initiator 132 and detonating cord 134 may be of the type commonly used in firing heads for perforating guns, tubing cutters, setting tools, etc. Thus, the tool 62 as shown in FIG. 4 may be a firing head or other tool in which it is desired to activate or detonate an explosive device. It will, therefore, be readily appreciated that the apparatus 40, and the valve 60 apart therefrom, may be used for a variety of applications, other than those specifically described herein, without departing from the principles of the present invention.

Note that the plunger 86 has a generally conical shaped end 136 for engagement with the initiator 132, the plunger operating as a firing pin as shown in FIG. 4. Since it is at times preferable for a firing pin to engage an explosive device with maximum impact to ensure detonation thereof, the tool 62 may be provided without the spring retainer 82, spring 84 and plunger 86, the end 136 instead being formed on a downwardly extending portion of the piston 64. In that manner, the piston 64 would impact the initiator 132 directly.

The valve 60, as shown in FIG. 4, has been downwardly displaced relative to the housing 112 by a weighted bar 138. The bar 138 has been dropped from the earth's surface, through the interior 46 of the tubing 44, into the fluid passage 50 and into contact with the upper end 128 of the member 92. This contact (or impact) has sheared the shear pin 90 and permitted the member 92 to displace downwardly. Thus, it is not necessary to achieve a differential pressure between the two pressure regions, the fluid passage 50 and the annulus 48, for operation of the valve 60 according to the principles of the present invention.

Of course, modifications, additions, substitutions, deletions and other changes may be made to the valve 60, the overall apparatus 40 and the methods described herein. Some of these possible changes have been described above and many others would be obvious to a person of ordinary skill in the art. These changes are contemplated by the principles of the present invention, even though only a few specific embodiments of the present invention have been described. Accordingly, the foregoing detailed description is to be clearly understood as being given by way of illustration and example only, the spirit and scope of the present invention being limited solely by the appended claims.

What is claimed is:

1. A valve operatively interconnectable to first and second pressure regions of a subterranean well, the valve comprising:

a member having first and second surface areas formed thereon, the first surface area being in fluid communication with the first pressure region, and the second surface area being in fluid communication with the second pressure region, when the valve is interconnected therewith, and the member displacing from a first position to a second position when fluid pressure in the first pressure region exceeds fluid pressure in the second region by a predetermined amount; and a chamber, the chamber being isolated from the second pressure region when the member is in the first position, and the chamber being in fluid communication with the second pressure region when the member is in the second position.

2. The valve according to claim 1, wherein the chamber has approximately atmospheric pressure therein when the member is in the first position.

3. The valve according to claim 1, further comprising a piston in fluid communication with the chamber.

4. The valve according to claim 3, further comprising a switch, the switch being operated by displacement of the piston when the chamber is in fluid communication with the second pressure region.

5. The valve according to claim 3, further comprising an explosive device, the explosive device being detonated by displacement of the piston when the chamber is in fluid communication with the second pressure region.

6. The valve according to claim 1, further comprising a shear device in engagement with the member, the shear device releasably securing the member in the first position until fluid pressure in the first region exceeds fluid pressure in the second region by the predetermined amount.

7. The valve according to claim 1, further comprising a generally tubular sleeve at least partially radially outwardly surrounding the member, the member being axially slidingly received within the sleeve.

8. The valve according to claim 7, wherein the sleeve has first and second seal bores formed internally thereon, and wherein the member has first and second diameters formed externally thereon, the first diameter sealingly engaging the first seal bore and the second diameter sealingly engaging the second seal bore.

9. The valve according to claim 8, wherein the first and second surface areas correspond to the area of the first seal bore.

10. A valve operatively positionable within a subterranean well, the well having a wellbore, a tubing string disposed therein, and an annulus formed between the wellbore and the tubing string, the valve comprising:

a housing sealingly connectable to the tubing string;

a first fluid passage in fluid communication with the interior of the tubing string when the housing is connected thereto;

a second fluid passage in fluid communication with the annulus when the housing is connected to the tubing string;

a chamber disposed at least partially within the housing; and a member disposed at least partially within the housing and displaceable relative thereto in a selected one of a first position in which the member prevents fluid communication between the second fluid passage and the chamber and a second position in which the member permits such fluid communication, the member being displaceable in response to a difference between fluid pressures in the first and second fluid passages.

11. The valve according to claim 10, wherein the member is axially reciprocably disposed within the housing, and wherein an end of the member extends into the first fluid passage.

12. The valve according to claim 10, wherein the member sealingly engages a seal bore at first and second axially spaced apart locations, and further comprising a third fluid passage intersecting the seal bore axially between the first and second locations.

13. The valve according to claim 12, wherein the third fluid passage is in fluid communication with the chamber.

14. The valve according to claim 13, wherein the member displaces relative to the seal bore to thereby permit fluid communication between the third fluid passage and the second fluid passage when the member displaces from the first to the second position.

15. The valve according to claim 10, further comprising a shear structure releasably securing the member against displacement relative to the housing.

16. The valve according to claim 10, wherein the member has a first piston area in fluid communication with the first fluid passage and a second piston area in fluid communication with the second fluid passage.

17. The valve according to claim 16, wherein the first piston area is approximately equal in area to the second piston area.

18. Apparatus operatively positionable within a subterranean well, the apparatus comprising:

a generally tubular housing;

a member in fluid communication with the interior of the housing and with the exterior of the housing, the member being selectively displaceable in response to a difference in fluid pressure between the interior and the exterior of the housing; and a fluid passage adjacent the member, the fluid passage being selectively communicated with, and isolated from, one of the interior and exterior of the housing in response to displacement of the member.

19. The apparatus according to claim 18, wherein the member is displaceable relative to the housing in response to a fluid pressure in the interior of the housing greater than a fluid pressure in the exterior of the housing by a predetermined amount.

20. The apparatus according to claim 18, wherein the member has a piston area formed thereon, one side of the piston area being exposed to fluid pressure within the interior of the housing and an oppositely oriented side of the piston area being exposed to fluid pressure in the exterior of the housing.

21. The apparatus according to claim 18, wherein the member has a generally rod shaped portion thereof, the rod shaped portion sealingly engaging a seal bore and straddling an intersection of the fluid passage with the seal bore.

22. The apparatus according to claim 18, wherein the fluid passage has approximately atmospheric pressure therein when the fluid passage is isolated from the one of the interior and exterior of the housing.

23. The apparatus according to claim 18, wherein the fluid passage is in fluid communication with the exterior of the housing when the member displaces relative to the housing.

24. The apparatus according to claim 18, further comprising a piston exposed to fluid pressure within the fluid passage.

25. Apparatus operatively positionable within a subterranean well, the apparatus comprising:

a switch disposed within a first chamber;

a piston reciprocably disposed sealingly between the first chamber and a second chamber, the piston being displaceable to engage the switch in response to a difference between fluid pressures in the first and second chambers; and a valve interconnected to the second chamber, the valve being positionable in a selected one of a first position in which the second chamber is isolated from fluid pressure within the well, and a second position in which the second chamber is opened to fluid pressure within the well.

26. The apparatus according to claim 25, wherein the first and second chambers have approximately atmospheric pressure therein when the valve is in the first position.

27. The apparatus according to claim 25, wherein the valve is selectively positionable in response to fluid pressure within the well.

28. The apparatus according to claim 27, wherein the valve is further selectively positionable in response to a difference in fluid pressure within the well.

29. The apparatus according to claim 28, wherein the valve is further selectively positionable in response to a predetermined difference in fluid pressure within the well.

30. The apparatus according to claim 25, wherein the second chamber is in fluid communication with an exterior of the valve when the valve is in the second position.

31. The apparatus according to claim 25, wherein the valve includes a member axially slidingly and sealingly disposed at least partially within a generally tubular housing.

32. The apparatus according to claim 31, wherein the second chamber is at least partially disposed within the housing.

33. The apparatus according to claim 31, further comprising a generally tubular sleeve disposed at least partially radially between the member and the housing.

34. Apparatus operatively positionable within a subterranean well, the apparatus comprising:

a switch disposed within a first chamber;

a piston reciprocably disposed sealingly between the first chamber and a second chamber, the piston being displaceable to engage the switch in response to a difference between fluid pressures in the first and second chambers;

a valve interconnected to the second chamber, the valve being positionable in a selected one of a first position in which the second chamber is isolated from fluid pressure within the well, and a second position in which the second chamber is opened to fluid pressure within the well, the valve including a member axially slidingly and sealingly disposed at least partially within a generally tubular housing;

a generally tubular sleeve disposed at least partially radially between the member and the housing; and a continuous fluid passage formed from the exterior of the housing, inwardly through a first sidewall portion of the sleeve, axially within the member, outwardly through a second sidewall portion of the sleeve and to the second chamber when the valve is in the second position.

35. Apparatus operatively positionable within a subterranean well, the apparatus comprising:

an explosive device disposed within a first chamber;

a piston reciprocably disposed sealingly between the first chamber and a second chamber, the piston being displaceable to detonate the explosive device in response to a difference between fluid pressures in the first and second chambers; and a valve interconnected to the second chamber, the valve being positionable in a selected one of a first position in which the second chamber is isolated from fluid pressure within the well, and a second position in which the second chamber is opened to fluid pressure within the well.

36. The apparatus according to claim 35, wherein the first and second chambers have approximately atmospheric pressure therein when the valve is in the first position.

37. The apparatus according to claim 35, wherein the valve is selectively positionable in response to fluid pressure within the well.

38. The apparatus according to claim 37, wherein the valve is further selectively positionable in response to a difference in fluid pressure within the well.

39. The apparatus according to claim 38, wherein the valve is further selectively positionable in response to a predetermined difference in fluid pressure within the well.

40. The apparatus according to claim 35, wherein the second chamber is in fluid communication with an exterior of the valve when the valve is in the second position.

41. The apparatus according to claim 35, wherein the valve includes a member axially slidingly and sealingly disposed at least partially within a generally tubular housing.

42. The apparatus according to claim 41, wherein the second chamber is at least partially disposed within the housing.

43. The apparatus according to claim 41, further comprising a generally tubular sleeve disposed at least partially radially between the member and the housing.

44. Apparatus operatively positionable within a subterranean well, the apparatus comprising:

an explosive device disposed within a first chamber;

a piston reciprocable disposed sealingly between the first chamber and a second chamber, the piston being displaceable to detonate the explosive device in response to a difference between fluid pressures in the first and second chambers;

a valve interconnected to the second chamber, the valve being positionable in a selected one of a first position in which the second chamber is isolated from fluid pressure within the well, and a second position in which the second chamber is opened to fluid pressure within the well, the valve including a member axially slidingly and sealingly disposed at least partially within a generally tubular housing;

a generally tubular sleeve disposed at least partially radially between the member and the housing; and a continuous fluid passage formed from the exterior of the housing, inwardly through a first sidewall portion of the sleeve, axially within the member, outwardly through a second sidewall portion of the sleeve and to the second chamber when the valve is in the second position.

45. A method of communicating fluid pressure to a chamber attached to a tubing string positioned within a subterranean well, the method comprising the steps of:

interconnecting a valve to the tubing string and the chamber, the valve being in fluid communication with each of the tubing string interior, the tubing string exterior and the chamber;

applying fluid pressure to the interior of the tubing string greater than fluid pressure on the exterior of the tubing string by a predetermined differential fluid pressure; and opening the valve in response to the predetermined differential fluid pressure.

46. The method according to claim 45, wherein the opening step further comprises placing the chamber in fluid communication with the interior of the tubing string.

47. The method according to claim 45, wherein the opening step further comprises shearing a shear member releasably securing the valve in a closed position.

48. The method according to claim 45, further comprising the step of permitting fluid communication between the interior and exterior of the tubing string before the applying step.

49. The method according to claim 48, further comprising the step of preventing fluid communication between the interior and exterior of the tubing string after the applying step.

50. The method according to claim 49, wherein the preventing step is performed in response to the applying step.

51. The method according to claim 45, further comprising the steps of releasing the predetermined differential fluid pressure and permitting fluid communication between the interior and exterior of the tubing string in response to the releasing step.

52. A method of actuating a tool positioned within a subterranean well wherein, for actuation thereof, a structure within the tool is to be engaged, the method comprising the steps of:

positioning the structure within a first chamber;

slidably disposing a piston relative to the structure, such that the piston is capable of engaging the structure in response to fluid pressure within a second chamber greater than fluid pressure within the first chamber; and interconnecting a valve to the second chamber and to first and second fluid pressure sources, the valve being openable to permit fluid communication between the second chamber and one of the first and second fluid pressure sources in response to a pressure differential between the first and second fluid pressure sources.

53. The method according to claim 52, further comprising the step of opening the valve in response to a fluid pressure in the first fluid pressure source greater than a fluid pressure in the second fluid pressure source by a predetermined amount.

54. The method according to claim 52, further comprising the step of opening the valve to thereby permit fluid communication between the first fluid pressure source and the second chamber.

55. The method according to claim 52, wherein the structure is a switch, and further comprising the step of engaging the piston with the switch by opening the valve.

56. The method according to claim 52, wherein the structure is an explosive device, and further comprising the step of engaging the piston with the explosive device by opening the valve.

57. The method according to claim 52, further comprising the step of opening the valve by impacting a portion of the valve with a weight to thereby displace the portion of the valve and permit fluid communication between the second chamber and the one of the first and second fluid pressure sources.

* * * * *